United States Patent [19]

Atherton et al.

[11] Patent Number: 4,904,906

[45] Date of Patent: Feb. 27, 1990

[54] FLUORESCENT LIGHT DIMMING

[75] Inventors: Larry S. Atherton, Anoka; Robert A. Black, Jr., Brooklyn Park; Arlon D. Kompelien, Richfield, all of Minn.

[73] Assignee: Honeywell Inc., Minneapolis, Minn.

[21] Appl. No.: 246,952

[22] Filed: Sep. 19, 1988

Related U.S. Application Data

[63] Continuation of Ser. No. 898,569, Aug. 21, 1986, abandoned.

[51] Int. Cl.[4] ..... H05B 41/36

[52] U.S. Cl. ..... 315/291; 315/241 R; 315/DIG. 4; 315/DIG. 7; 315/219

[58] Field of Search ..... 315/291, 207, 199, 210, 315/241 R, 325, 205, DIG. 4, 251, DIG. 2, 219, DIG. 7, 311, 294; 307/253

[56] References Cited

U.S. PATENT DOCUMENTS

| | | | |
|---|---|---|---|
| 3,308,800 | 3/1967 | Mott, Jr. et al. | 315/209 |
| 3,422,309 | 1/1969 | Spira et al. | 315/199 |
| 3,469,113 | 9/1969 | Hanchett | 307/305 |
| 3,487,231 | 12/1969 | Dixon | 307/252 |
| 3,679,936 | 7/1972 | Moerkens | 315/205 |
| 3,767,970 | 10/1973 | Collins | 315/241 R |
| 3,935,505 | 1/1976 | Spiteri | 315/194 |
| 4,023,049 | 5/1977 | Brooks | 307/252 |
| 4,099,099 | 7/1978 | Grudelbach . | |
| 4,129,791 | 12/1978 | Sato | 307/252 |
| 4,262,234 | 4/1981 | Dakroub | 315/291 |
| 4,350,935 | 9/1982 | Spira et al. | 315/291 |
| 4,352,045 | 9/1982 | Widmayer | 315/291 |
| 4,388,565 | 6/1983 | Rividi | 315/291 |
| 4,392,046 | 7/1983 | Tzeng | 219/130.1 |
| 4,527,099 | 7/1985 | Capewell et al. | 315/291 |
| 4,529,888 | 7/1985 | Fleischer | 307/252 |

OTHER PUBLICATIONS

"AC Power Control of an R-L Load", Dubey et al., IEEE Trans. on Industrial Electronics & Control Instr., vol. IECI-24, No. 1, Feb. '77, pp. 38-41.

"Symmetrically Pulse Width Modulated AC Chopper", Revenkar et al., IEEE Trans. on Ind. Elec. & Control Instr., vol. IECI-24, No. 1, Feb. '77, pp. 39-44.

"Three-Phase AC Power Control Using Power Transistors", Mozdzer, Jr. et al., IEEE Trans. on Ind. Appl., vol. IA-12, No. 5, Sep./Oct. '76, pp. 499-505.

"A.C. Voltage Regulation by Means of Chopper Circuits", Elec. Letters, Jan. 26, '68, vol. 4, No. 2, pp. 26-28.

"Steady-State Analysis of the Series Resistance-Inductance Circuit with Controlled Switches", Bland, IEEE Trans. on Ind. Elec. & Control Instr., vol. IECI-23, No. 2, May '76, pp. 171-178.

*Primary Examiner*—Leo H. Boudreau
*Assistant Examiner*—Michael Razavi
*Attorney, Agent, or Firm*—Kinney & Lange

[57] ABSTRACT

A dimmer for a fluorescent light in which the fluorescent light is supplied with an electrical signal having a varying magnitude, the dimmer positioning a notch of reduced signal magnitude within the electrical signal for controlling the illumination level of the fluorescent light wherein the illumination level is dependent upon the position of the notch within the varying electrical signal.

25 Claims, 8 Drawing Sheets

FLUORESCENT LIGHT DIMMING

This application is a continuation of application Ser. No. 898,569, filed Aug. 21, 1986.

BACKGROUND OF THE INVENTION

The present invention relates to an illumination control arrangement for controlling the amount of light emitted by a fluorescent lamp.

Such arrangements for controlling the amount of illumination emitted by a source of light is typically called a dimming control arrangement. Incandescent lamps have typically been dimmed either by using a diode (full illumination without the diode in the circuit and reduced illumination with the diode in the circuit) or a rheostat. Fluorescent lights have been tyically dimmed in the prior art by the use of either phase turn on or phase turnoff control.

In phase turn on control, the current supplied by an alternating current source is kept off until a predetermined point in the alternating current cycle is reached at which time current is allowed to flow to the fluorescent light until the next zero point in the alternating current cycle. By adjusting this predetermined point, the amount of light emitted by the fluorescent light can be controlled.

In phase turn off control, current is supplied to the fluorescent light beginning with the zero point in the alternating current cycle but is turned off at some predetermined phase and held off until the next zero point in the alternating current cycle. Again, by adjusting the predetermined phase for turn off, the amount of light emitted by the fluorescent light can be controlled.

The prior art, as shown in U.S. Pat. No. 4,350,935, also discloses a notch control arrangement for a fluorescent light wherein current is supplied to the light beginning with the zero point in the alternating current supply voltage, turned off at a first predetermined phase, and turned back on at a second predetermined phase after which the alternating current is allowed to flow to the load through the next zero point in the alternating current supply voltage until the next phase turn off point is reached. The width of the notch is adjusted for controlling the amount of light emitted by the fluorescent light.

Dimming of fluorescent lights over a wide range has proven elusive. The excitation of the molecules of the gas within the fluorescent light causes the gas to emit light. Dimming is achieved by controlling the ionizing current through the fluorescent light to control the amount of excitation of the gas molecules. In order to excite the gas molecules within the light, however, the filament/cathodes are heated by electric current to reduce the work function for their emmission of electrons and allow the voltage gradient to develop in the gas so the gas molecules can become ionized. One object of prior art fluorescent light dimming arrangements is to provide a control circuit which maintains the filament/cathode voltage high enough to maintain a low work function to emit electrons while at the same time controlling the amount of ionizing current to thus control the amount of emitted light. However, these prior art arrangements have been unable to dim fluorescent lights to very low levels. The present invention is able both to achieve control of the ionizing current without unduly sacrificing filament/cathode voltage and to achieve a wider range of illumination control by controlling the position of a notch in the line voltage waveform.

SUMMARY OF THE INVENTION

Accordingly, the control arrangement of the present invention dims a fluorescent light by controlling the position of a notch of reduced signal magnitude within the electrical signal waveform supplied to the fluorescent light. This arrangement includes a load control for controlling the supply of the electrical signal to the fluorescent light, a light level determiner for providing a light level signal determinative of the amount of light to be emitted by the fluorescent light, and a light controller responsive to the electrical signal and to the light level signal for controlling the load control to position the notch within the electrical signal waveform in accordance with the light level signal. In this way, the illumination level of the fluorescent light is controlled by the position of the notch within the electrical signal voltage.

BRIEF DESCRIPTION OF THE DRAWINGS

These and other features and advantages will become apparent from a detailed consideration of the invention taken in conjunction with the drawings in which.

DETAILED DESCRIPTION

Figure 1:
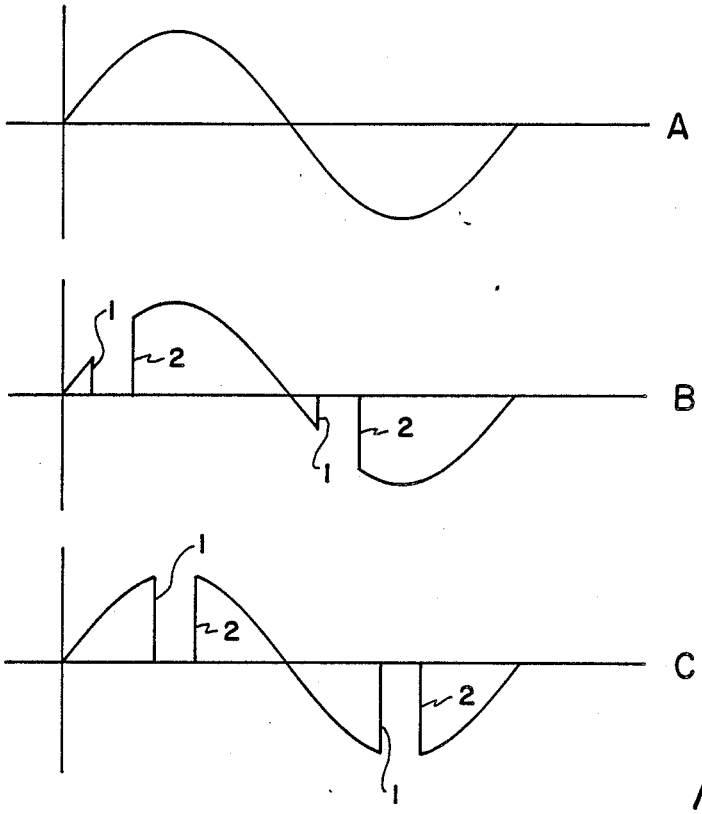
FIG. 1 shows the electrical signal waveform supplied to the fluorescent light with the notch at different positions within the electrical signal waveform.

Waveform A in FIG. 1 shows the electrical supply signal waveform, typically an alternating voltage, available for supply to a fluorescent light which might be located within a building and the illumination of which is to be controlled. The present invention creates a notch within the electrical signal waveform supplied to the light. This notch is of reduced signal magnitude which preferably but not necessarily results in a zero electrical signal being supplied to the fluorescent light during the notch. Full illumination of the fluorescent light can be achieved by supplying the electrical signal to the fluorescent light without a notch. No illumination of the fluorescent light can be achieved by supplying no electrical signal to the fluorescent light. Between these two extremes, the amount of illumination of the fluorescent light can be achieved dependent upon the position of the notch within the electrical signal waveform. For example, by positioning the notch near the zero crossover point as shown in waveform B of FIG. 1, the fluorescent light will be operated at greater intensity while sliding the notch over to the midpoint in the electrical signal cycle a shown in waveform C of FIG. 1 results in reduced illumination.

Figure 2:
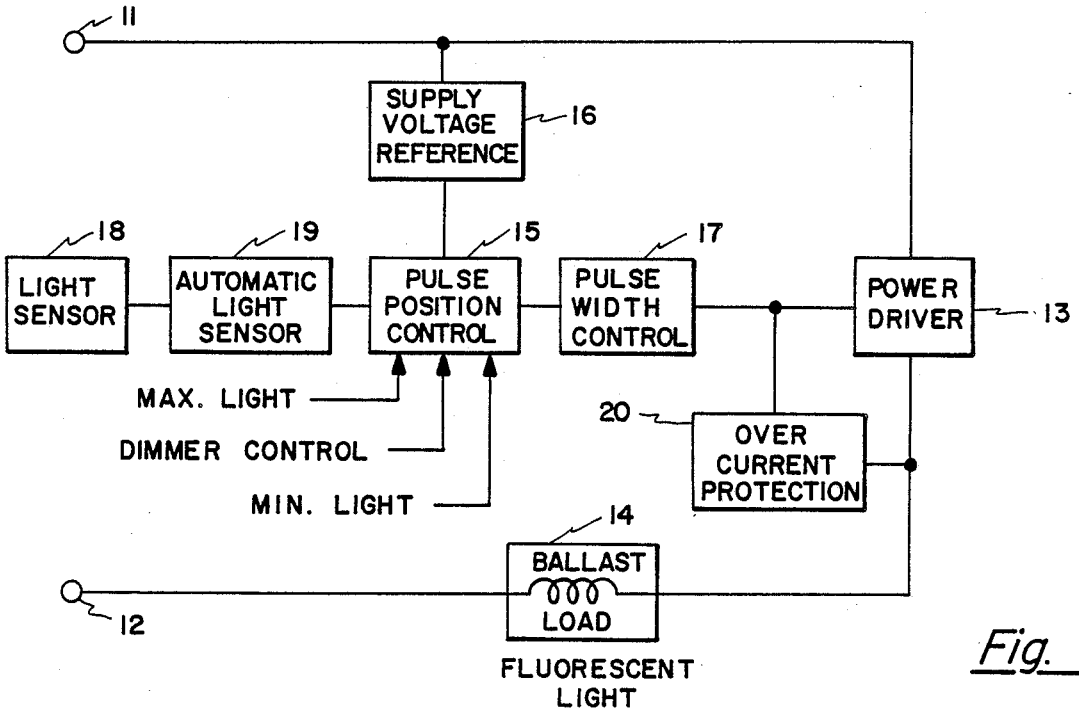
FIG. 2 is a block diagram of the present invention.

FIG. 2 shows a block diagram of a system for controlling the position of the notch shown in FIG. 1. The electrical signal which is used to power the fluorescent light is supplied to the arrangement shown in FIG. 2 at terminals 11 and 12. Power driver 13, which may be in the form of a switch or other type of electrical signal controller, is operated to create the notch within the electrical signal waveform. For example, power driver 13 is turned on at the zero point in the signal cycle for supplying the electrical signal to the ballast load 14 of the fluorescent light until the leading edge 1 of the notch shown in FIG. 1. At the leading edge, power driver 13 is turned off to interrupt the electrical signal to the load 14 until the trailing edge 2 of the notch is achieved. At this trailing edge, power driver 13 then is again turned on to resume the supply of electrical signal to load 14.

The position of the notch is controlled by pulse position control 15 in response to a dimmer control or predetermined light level signal which determines the amount of illumination of the fluorescent light. An electrical signal reference circuit, which may be voltage reference circuit 16, is connected to terminal 11 to provide a point of reference so that the position of the notch can be controlled and adjusted with respect to this reference point of the electrical supply signal. This reference point can be the zero crossover point in the alternating supply voltage waveform. A maximum light input can also be supplied for setting the maximum light of which the fluorescent light is capable of emitting. To prevent visible light flicker, a pulse width control circuit 17 may be included to provide a smooth transition from full on condition to a dimming condition near the point of maximum light output. Additionally, a light sensor 18 and an automatic light control arrangement 19 can be provided if the illumination of the fluorescent light is to be adjusted according to ambient light conditions. Finally, an over current protection circuit 20 can be provided for protecting the power driver 13 against over current conditions. Any or all of light sensor 18, automatic light control 19, pulse width control 17 and over current protection 20 may be eliminated from the embodiments shown in FIGS. 3–5 as being unnecessary.

Figure 3:
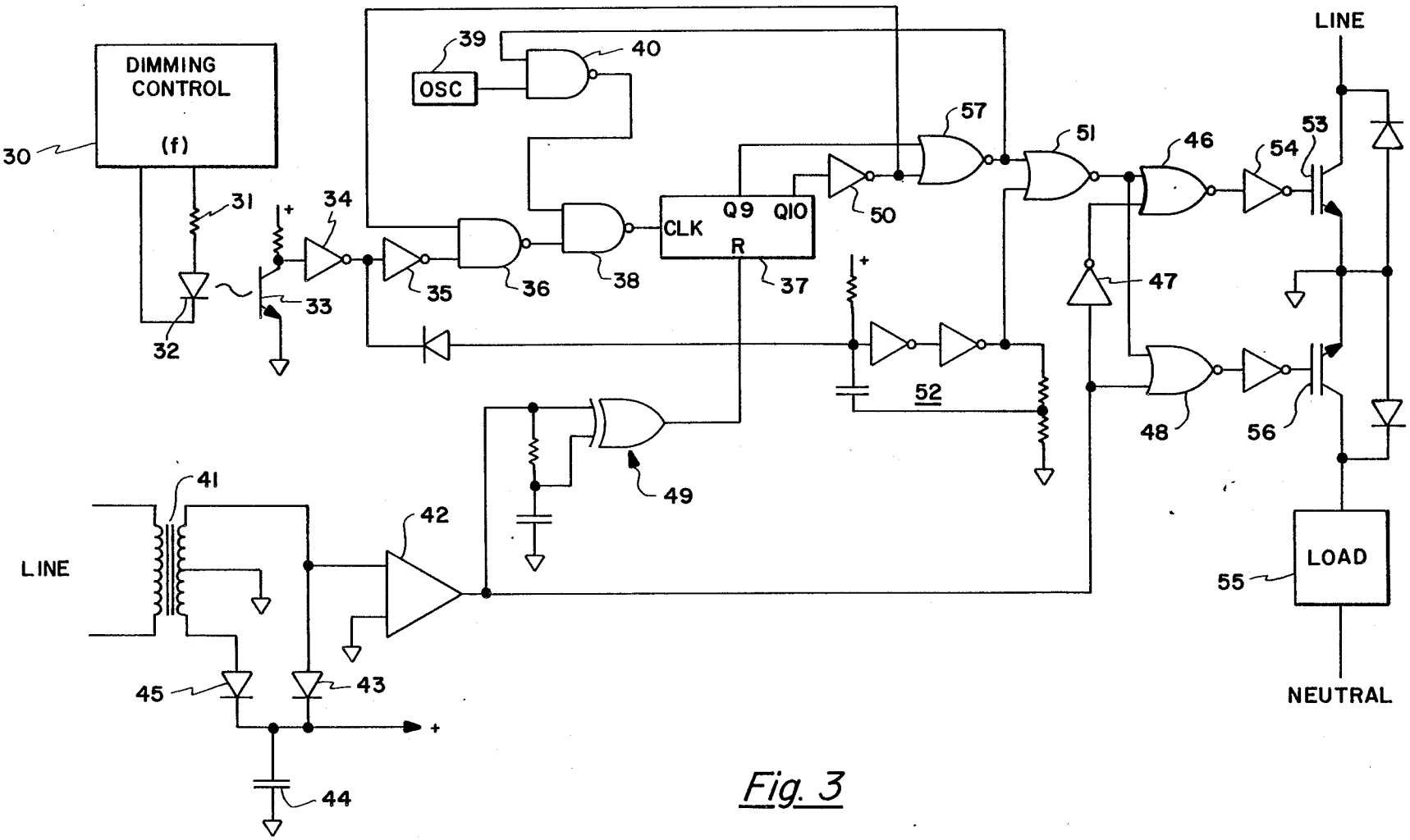
FIG. 3 shows one form of the present invention.

As shown in FIG. 3, the frequency of the dimming control signal supplied by dimming control signal source 30 determines the level of illumination of the light load 55. This frequency determines the position of the leading edge of the notch. The dimming control signal is supplied through resistor 31 to light emitting diode 32. The light emitted by light emitting diode 32 will pulse in accordance with the frequency of the signal supplied by dimming control 30. These signal light pulses will be sensed by phototransistor 33 which converts the pulsed light signal to a pulsed electrical signal. This pulsed electrical signal is inverted by inverters 34 and 35 and supplied to one input of NAND gate 36 the other input of which is supplied as an inverted output from output Q10 of counter 37. Counter 37 is a conventional binary ripple counter type. The output of NAND gate 36 is supplied to one input of NAND gate 38 the output of which is used for clocking counter 37. NAND gate 38 is conditioned by its other input to pass the pulses being supplied by dimming control 30 for driving counter 37 to the leading edge of the notch. Counter 37 will count these pulses until output Q9 is triggered at which point oscillator 39 is connected through NAND gates 40 and 38 to the clock input of counter 37. Oscillator 39 is a fixed frequency output which will maintain the width of the notch constant. Oscillator 39 will continue to clock counter 37 until output Q10 goes true at which point the trailing edge of the notch has been attained and the electrical signal is again supplied to the load.

In order to control the position of the notch, a reference must be established. In the case of an alternating voltage supply, the reference can conveniently be the zero crossover point in the supply voltage cycle. Accordingly, the primary of transformer 41 is connected to the line supply voltage. One end of the secondary of transformer 41 is connected as an input to comparator 42 and also through diode 43 to one side of capacitor 44 the other side of which is connected to circuit common. The other side of the secondary of transformer 41 is connected through diode 45 to the junction of diode 43 and capacitor 44. Capacitor 44 then supplies a positive signal for powering the electronics of the circuit shown in FIG. 3. The secondary of transformer 41 may have a center tap which is connected to circuit common.

Comparator 42 supplies a square wave output which is high during the positive half cycle of the line supply voltage and low during the negative half cycle. Thus, the output of comparator 42 is connected through inverter 47 to one input of NOR gate 46 and is connected to one input of NOR gate 48. The output of comparator 42 is also supplied through a differentiator 49 designed to supply reset pulses to counter 37 at the zero crossover points in the alternating voltage cycle. This differentiator is made up of an EXCLUSIVE OR gate such that it supplies reset pulses independent of the direction of voltage during the zero crossing. Consequently, counter 37 is reset at each zero point in the alternating voltage cycle.

At the beginning of the positive half of the voltage cycle, i.e. at the zero crossover point, both outputs Q9 and Q10 will be low. Thus, one input of NOR gate 57 will be low, i.e. the input from terminal Q9 of counter 37, and the other input will be high by virtue of inverter 50. The output of NOR gate 57 is, therefore, low to disable NAND gate 40 from supplying the output of oscillator 39 to counter 37 and also to maintain one input of NOR gate 51 at a low state. The other input of NOR gate 51 comes from full off logic circuit 52. Full off logic circuit 52 normally has a low output. This output will, however, go high when no pulses are emitted by phototansistor 33 and the phototransistor is on such that the output of inverter 34 remains high, indicating that the load should be in an off state. During the supply voltage half cycle when the line input to power switch 53 is positive the output of comparator 42 is also high. During this time then, both inputs to NOR gate 46 are low so its output is high. Inverter 54 then keeps the control input of power switch 53 low during this positive half cycle and maintains the off state. Power switch 53 is not a controlling element during the negative half cycle at which time load switch 56 works in like fashion.

At the beginning of the electrical supply signal cycle when the fluorescent light is not to be full on, the output of NOR gate 51 high and the output of NOR gate 46 will be low because its other input is low during positive half cycles of the voltage being supplied to the load. Since the output of NOR gate 46 is low, the input to insulated gate field effect transistor 53 is high because of inverter 54. Thus, transistor 53 is on to supply line voltage to load 55.

During initial counting of counter 37, both its Q9 and Q10 outputs are low resulting in one input to NOR gate 57 being low and the other input being high. Consequently, its output is low which results in one input of NOR gate 51 being low. The other input of NOR gate 51 is low because the output of full off logic circuit 52 is low. When counter 37 receives a sufficient count for its Q9 output to go high, the output of NOR gate 57 does not switch. However, when the output of Q9 goes low and the output of Q10 goes high (at the beginning of the notch), both inputs to NOR gate 57 are now low which switches its output high which switches the output of NOR gate 51 low which switches the output of NOR gate 46 high for turning off transistor 53. At the same time, NAND gate 36 cuts off the supply of the signal from dimming control 30 to counter 37 and instead NAND gate 40 is enabled to take over the clocking of counter 37 by oscillator 39.

Counter 37 will continue to count pulses from oscillator 39 until its output Q9 again goes high at which time the output of NOR gate 57 will go low. When the output of NOR gate 57 goes low, the output of NOR gate 51 will go high, the output of NOR gate 46 will go low and transistor 53 will turn back on at the trailing edge of the notch. Transistor 53 will stay on until the next zero point in the cycle because NAND gate 40 is disabled and the counter receives no more clocking pulses. When the voltage cycle goes negative, counter 37 is reset to restore the output of NOR gate 51 to a low and NOR gate 48 will now be in condition for switching transistor 56 on at the zero point in the voltage cycle, off at the leading edge of the notch and back on at the trailing edge of the notch.

Figure 4:
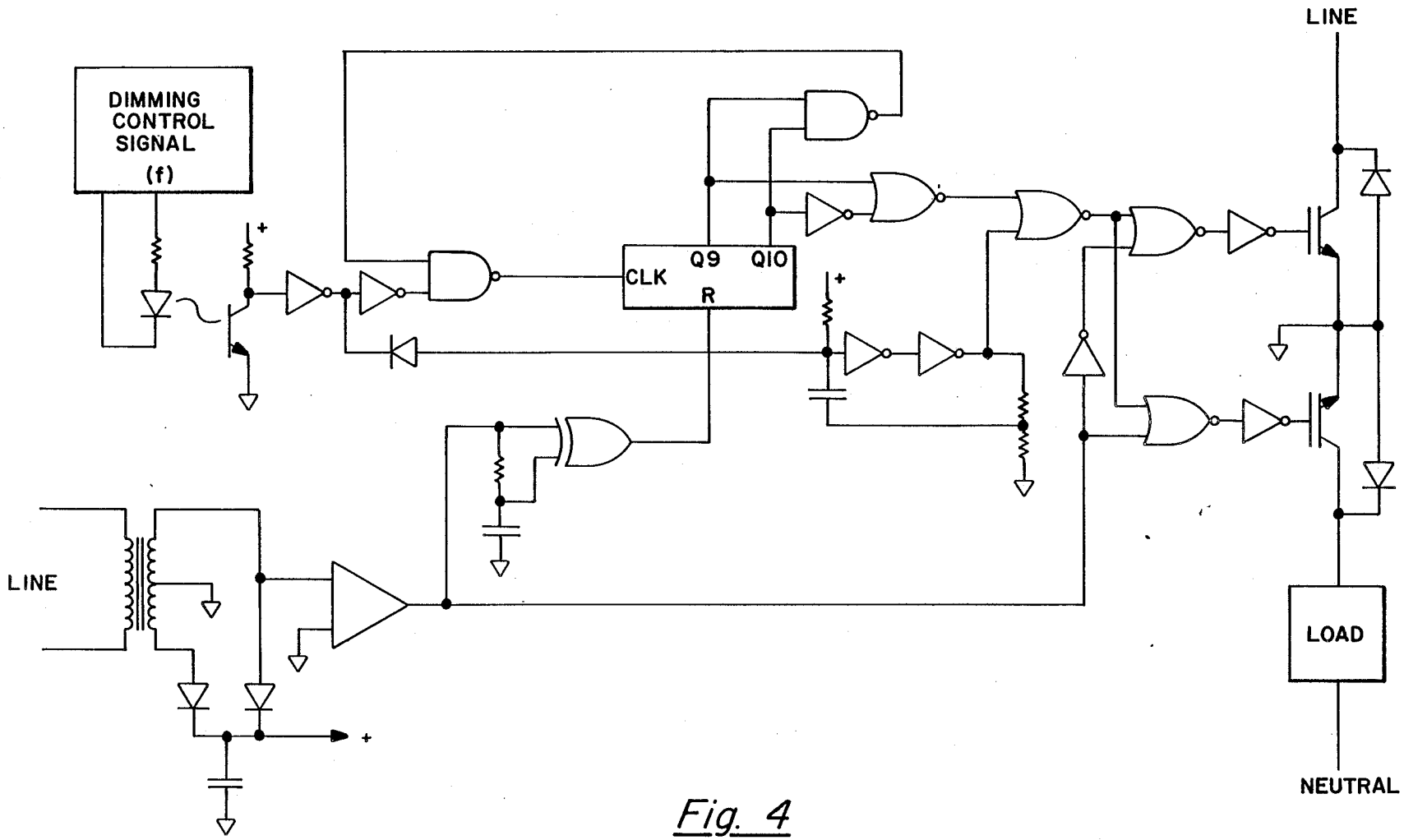
FIG. 4 shows an alternative form of the present invention.

As shown in FIG. 3, the notch will have a fixed duration because oscillator 39 delivers a fixed frequency to counter 37 between the leading edge and the trailing edge of the notch. If it is not necessary that the notch have a fixed width, then counter 37 can be driven solely by the dimming control signal from source 30 as shown in FIG. 4. Thus, as the frequency of the signal from dimming control 30 increases, the leading edge of the notch, which occurs when the load controlling transistors are turned off, will occur sooner in the alternating voltage cycle because the counter is counting at a faster rate. As the counter is counting at the faster rate, the time between the leading edge and the trailing edge of the notch will also decrease. As the frequency of the signal from dimming control 30 decreases, the leading edge will occur later because the counter is counting at a slower rate. As the counter is counting at the slower rate, the time between the leading edge and trailing edge will also increase. Since the arrangement shown in FIG. 4 is nearly identical to the arrangement of FIG. 3, the arrangement shown in FIG. 4 has not been discussed in detail. A shunt switch across load 55, such as switch 102 shown and discussed with respect to FIG. 5C, should also be included in the arrangements shown in FIGS. 3 and 4 for proper performance.

Figure 5A:
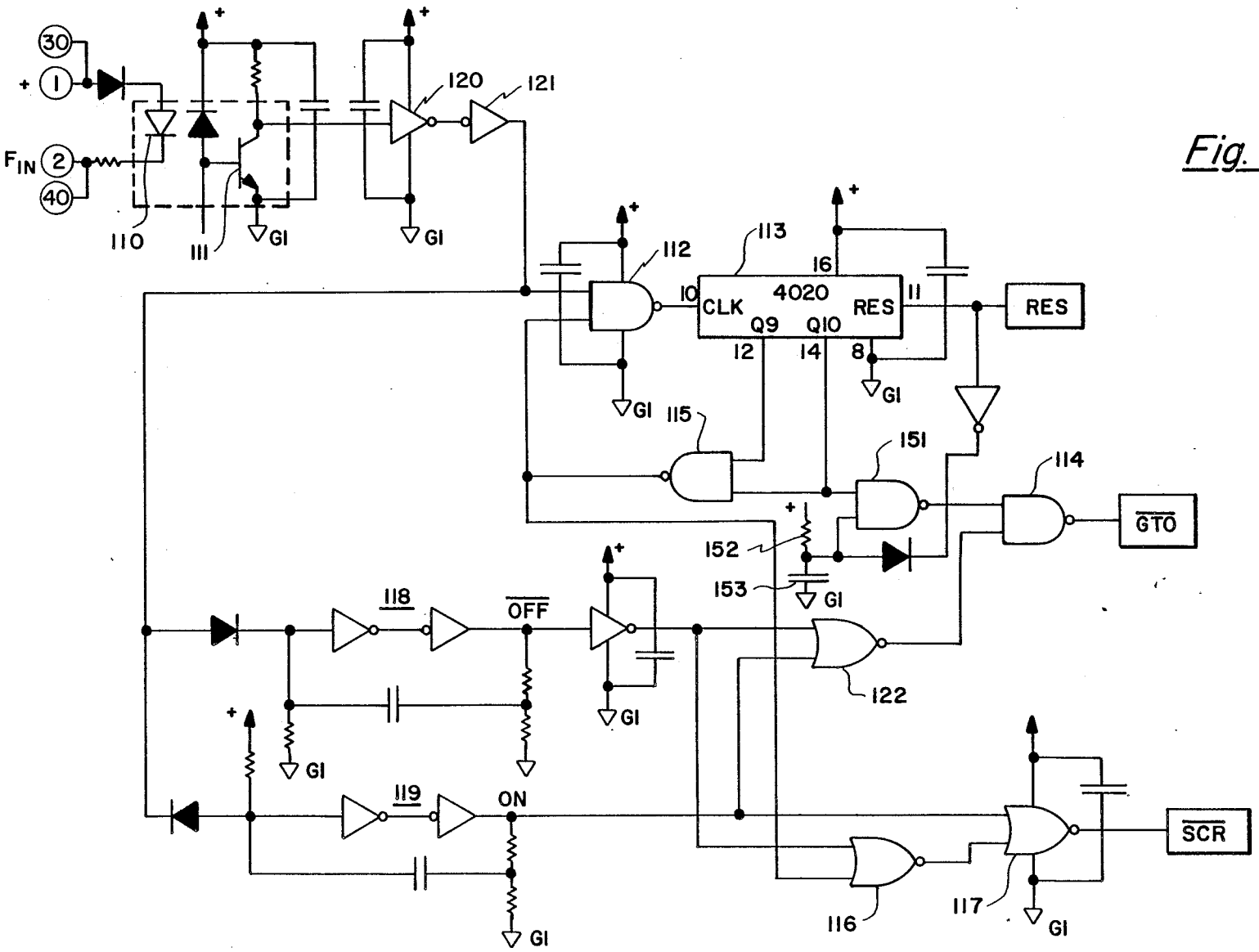
FIGS. 5A–5C show another form of the present invention.
Figure 5B:
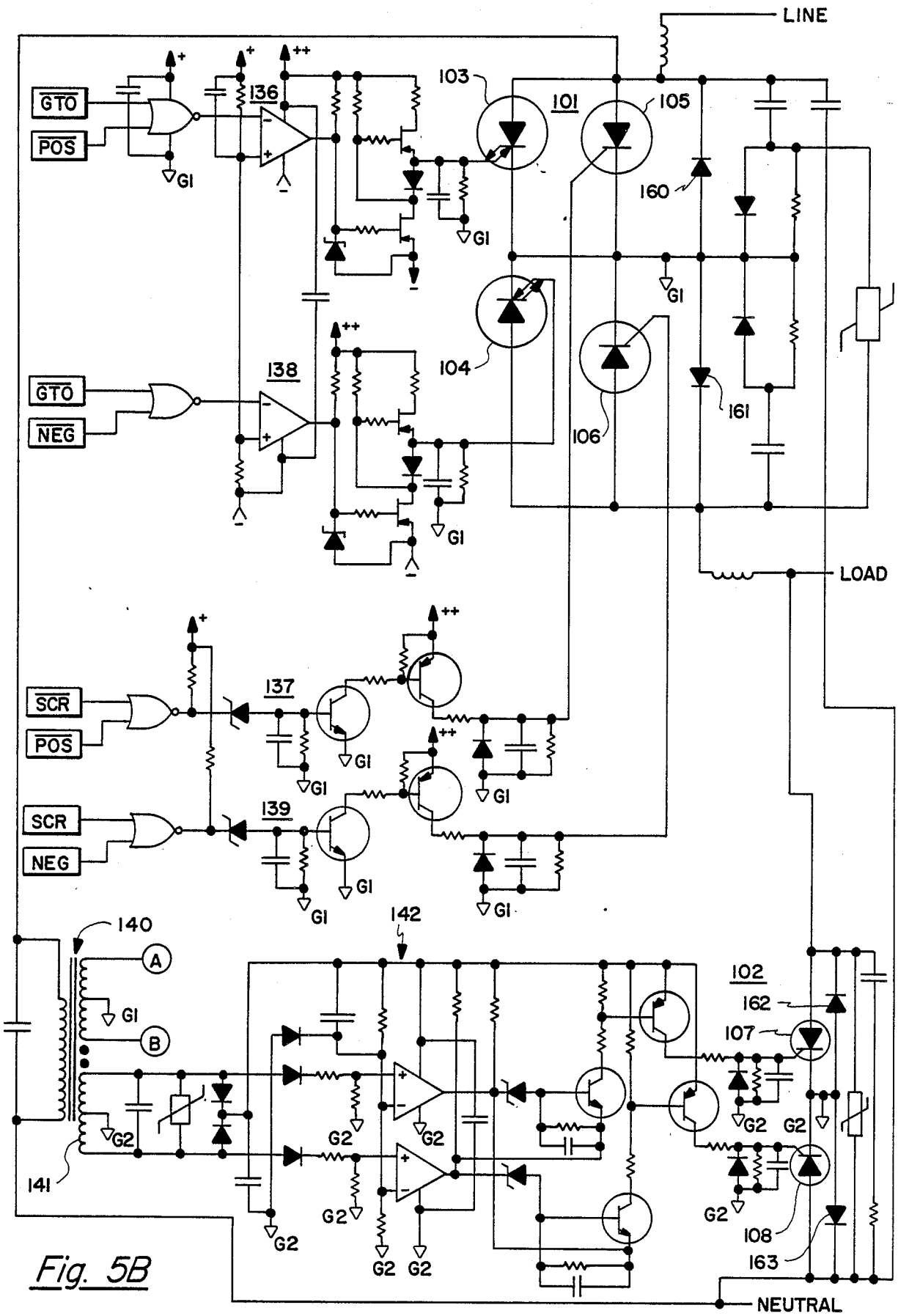
Figure 5C:
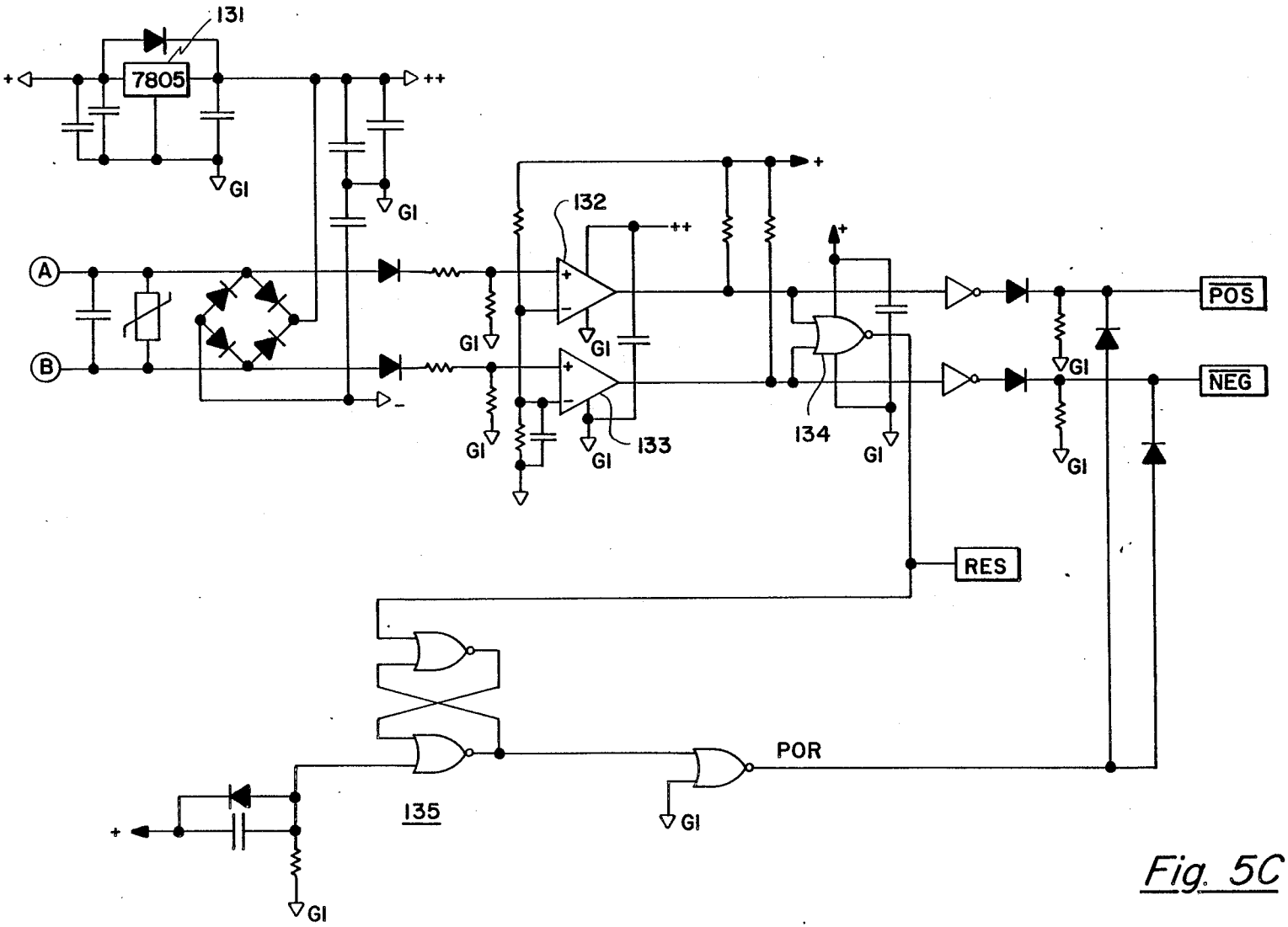

A further embodiment of the present invention is shown in FIGS. 5A–5C. The electrical signal, which may be preferably an alternating voltage signal, is applied between the LINE and NEUTRAL lines shown in FIG. 5B. The load in the form of the inductive ballast of a fluorescent light is connected between the LOAD and NEUTRAL lines. Series switch 101 controls the application of both positive and negative half cycle of the electrical signal to the load and parallel switch 102 provides a current path for the stored energy in the inductive ballast during the notch created by operation of switch 101. Although a parallel switch such as switch 102 is not shown in the embodiments of FIGS. 3 and 4, it is understood that it very well may be desirable to have such a switch operating in much the same fashion as switch 102 operates in the embodiment of FIGS. 5A–5C.

Series switch 101 comprises a pair of gate turn off (GTO) devices 103 and 104 with GTO 103 for controlling positive half cycles and GTO 104 for controlling negative half cycles. In parallel with GTO 103 is an SCR 105 and in parallel with GTO 104 is an SCR 106. In series with the GTO/SCR pairs are conduction diodes 160 and 161 with diode 161 to conduct load current during the positive half cycle and diode 160 to conduct load current during the negative half cycle. Various additional diodes, resistors, capacitors and varistors are connected as shown for transient and noise suppression. The GTO devices are gated on at the zero voltage crossover point in their respective half cycles and are gated off at the leading edge of the notch. The appropriate parallel SCR is then turned on at the trailing edge of the notch and will stay on until the zero crossover point in the current cycle is reached.

The parallel switch is comprised of SCR 107 and SCR 108, diodes 162 and 163 with a capacitor, a resistor and a varistor connected in parallel for transient and noise suppression. When current flow is interrupted to an inductor, the energy stored within the inductor tends to induce a current flow in the same direction of the current flowing through the inductor when power is connected to the inductor. This current flow is allowed to continue circulating by SCR 108 and diode 162 in the positive half cycle and by SCR 107 and diode 163 during the negative half cycle. Accordingly, during the positive half cycles which are being controlled by GTO 103 and SCR 105, SCR 108 is conducting during the notch.

In FIG. 5A, a dimming control signal from a circuit such as dimming control circuit 30 shown in FIG. 3 is supplied to terminal $F_{IN}$ which pulls down this terminal at the frequency of the dimming control signal. Thus, pulses of light having the frequency of the dimming control signal are emitted by LED 110 and are sensed by phototransistor 111 which converts the optical pulses into electrical pulses. These pulses are buffered and then supplied to one input of NAND gate 112 and are used for clocking counter 113. Counter 113 may be a conventional binary ripple counter. A reset signal RES is supplied to the counter by the circuit shown in FIG. 5C. This reset signal appears at each zero crossing of the voltage waveform supplied to the LINE and NEUTRAL lines. Thus, counter 113 will always begin counting at the same place in the voltage cycles.

Figure 6:
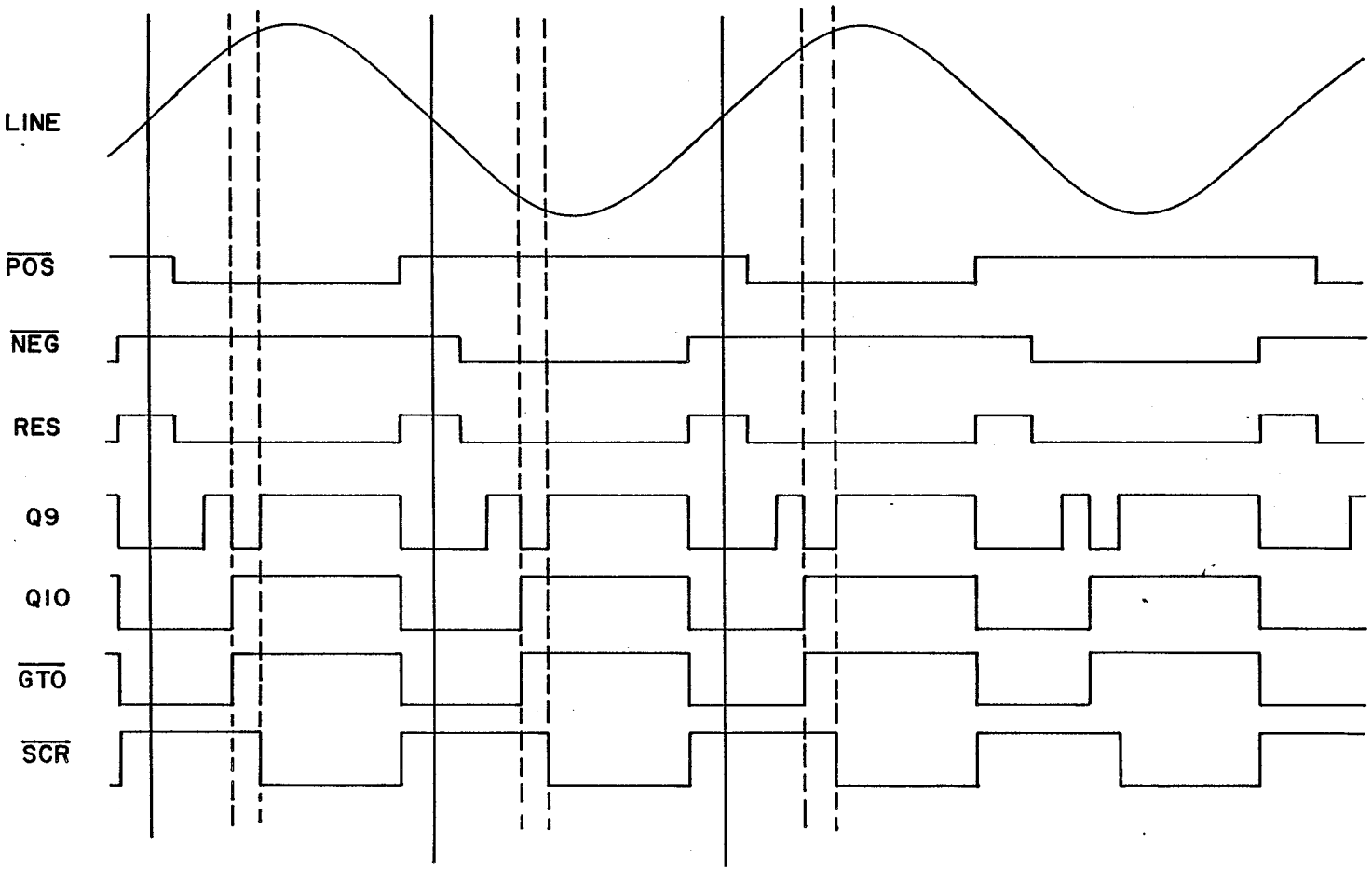
FIG. 6 shows a timing diagram for the circuit shown in FIGS. 5A–5C; and, FIG. 7 shows the configuration of the FIGS. 5A–5C embodiment into a three phase system.

Shown in FIG. 6 is the line signal having the notch represented in dashed lines. At the beginning of any counting cycle, terminal Q10 is low which, because of NAND gate 151, supplies a high signal to one input of NAND gate 114 the other input of which is also high. This combination of inputs causes an active low $\overline{GTO}$ signal to be supplied to the circuit of FIG. 5B which will cause GTO 103 to conduct during the beginning of the positive half cycle.

As counter 113 continues counting, output Q9 will go high which has no effect on the circuit. When Q9 goes low, output Q10 goes high which terminates the GTO signal at the leading edge of the notch. Thus, GTO device 103 is turned off. Since output Q9 is low and output Q10 is high, the output of NAND gate 115 is high which, through NOR gates 116 and 117, holds the signal $\overline{SCR}$ high. When Q9 goes high again at the trailing edge of the notch, the output from NAND gate 115 goes low which drives the signal $\overline{SCR}$ low which turns on SCR 105 which then remains conducting during the remainder of the positive half cycle.

Thus, the load is supplied with voltage from the zero crossover point of the positive half cycle up to the leading edge of the notch. Voltage is terminated during the notch but is resumed at the trailing edge of the notch and continues until the zero crossover point in the cycle is again reached.

NAND gate 151 together with resistor 152 and capacitor 153 form a delay circuit insuring a minimum on time of the GTO. At increasing control input frequencies (near maximum light output) the delay circuit causes the notch to dissappear or approach zero width, at which point the load is full on. This provides a "flicker free" visible transition from a dimming condition near the point of maximum light output to the full on condition.

Circuit 119 (FIG. 5A) senses the condition where the fluorescent light is to be full on and no notch is to be supplied in the line voltage signal. In this case, phototransistor 111 receives no light which drives the output of inverter 120 low and the output of inverter 121 continually high. Thus, full on circuit 119 supplies a high output to one input of NOR gate 117 and also NOR gate 122, which in turn cause the SCR to be conducting during the entire half cycle and the GTO t be off during the entire half cycle, respectively. By the same token, a continuous signal supplied to LED 110 means that the output of buffer 121 is continually low which causes a low signal to be supplied by full on circuit 119 and a low signal to be supplied by full off circuit 118. These signals insure that both of the active signals $\overline{GTO}$ and $\overline{SCR}$ are held high (neither device conducts during any part of the cycle).

The circuit shown in FIG. 5C is designed to control which GTO devices and SCRs in series switch 101 are allowed to be operational depending upon the half cycle, to provide the reset signal RES to the counter, and to supply the power for the electronics of the control arrangement. Thus, terminals A and B are supplied with the line signal from transformer 140 shown in FIG. 5B.

The line signal is rectified and supplied to regulator 131 as shown. The line signal is also supplied to comparators 132 and 133 which are level sensing devices and provide the signals $\overline{POS}$ and $\overline{NEG}$ as shown in FIG. 6. Furthermore, both of these signals are supplied to NOR gate 134 which provides the reset signal RES to the counter. This signal is also shown in FIG. 6. Because comparators 132 and 133 are level or threshold sensing devices, there will be an overlap of the signals $\overline{POS}$ and $\overline{NEG}$ around the zero point in the electrical signal cycle. This overlap provides the pulses shown a the signal RES in FIG. 6.

A power on reset circuit 135 provides a signal which prevents the electronics from operating until a reset signal is received at the zero point in the current cycle. At this point, the power on reset circuit 135 is unlatched and the electronic circuit is free to operate.

The signals $\overline{GTO}$, $\overline{SCR}$, $\overline{POS}$ and $\overline{NEG}$ are supplied to the terminals as shown in FIG. 5B. When $\overline{POS}$ is low, the $\overline{GTO}$ signal is allowed to pass through switching circuit 136 for gating on GTO device 103 and for turning it off at the leading edge of the notch. Also, the signal $\overline{SCR}$ is allowed to operate through circuit 137 for firing SCR 105 beginning at the trailing edge of the notch. Likewise, when signal $\overline{NEG}$ goes low, then the signal $\overline{GTO}$ is allowed to operate through switching circuit 138 and the signal $\overline{SCR}$ is allowed to operate through circuit 139 for controlling GTO 104 and SCR 106 respectively for providing the notch in the negative half cycle.

Secondary winding 141 of transformer 140 supplies the electrical signal on the line to threshold sensing circuit 142 (FIG. 5B). This circuit will fire SCR 108 during positive half cycles and SC 107 during negative half cycles to allow current flow from and through the ballast during the notch periods when the driving voltage is low.

As in the previous embodiments, the position of the notch is varied dependent upon the frequency supplied to LED 110. A higher frequency causes the counter to count at a faster rate resulting in an earlier occurring notch and a lower frequency causes the counter to count more slowly resulting in a later occurring notch. In this way, the amount of illumination supplied by the fluorescent light connected between the LOAD and NEUTRAL lines of FIG. 5B is controlled. A lower frequency results in less illumination and a higher frequency results in more illumination.

Figure 7:
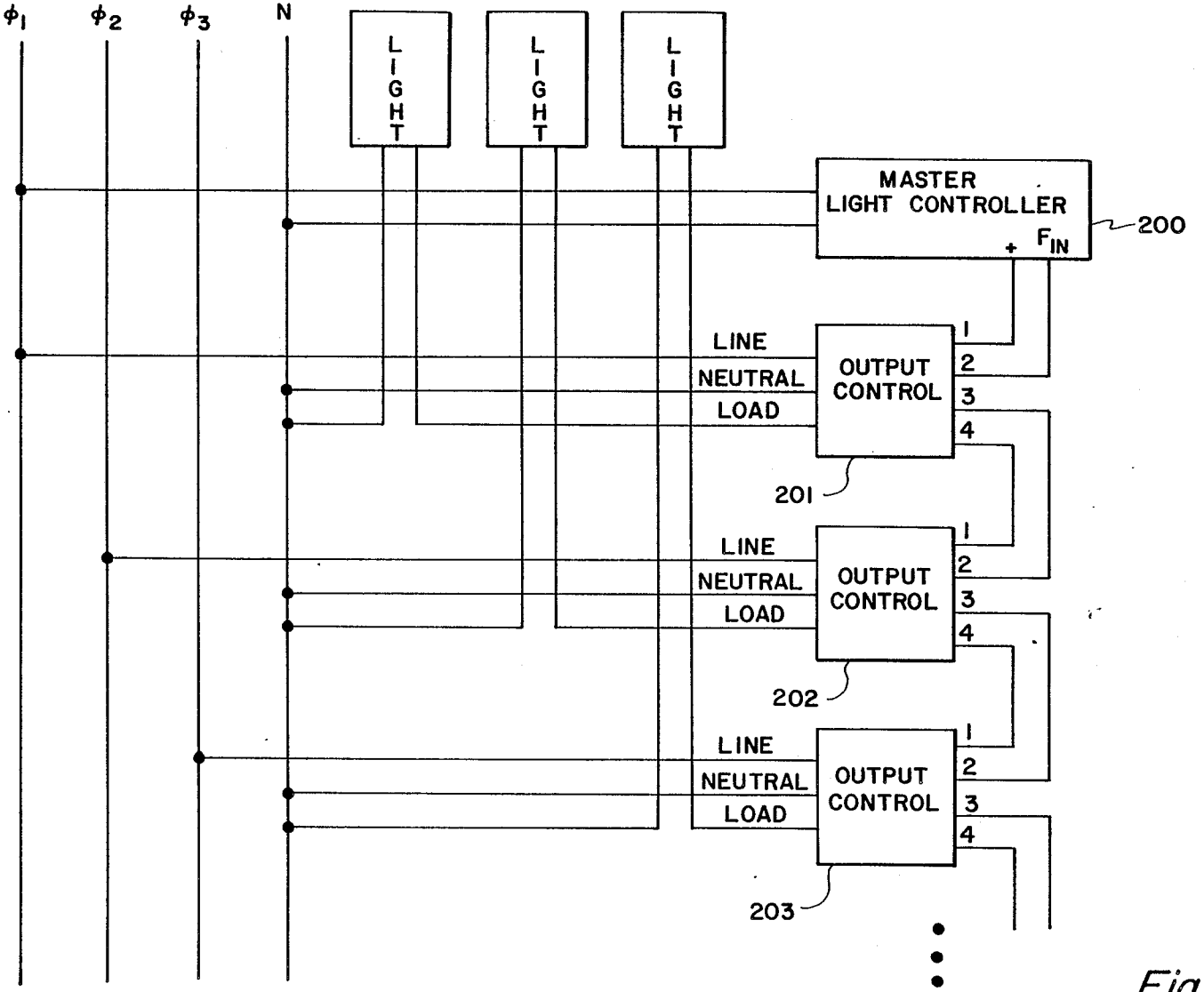

FIG. 7 shows how the present invention, particularly as embodied in FIGS. 5A–5C, can be used in a three phase alternating current system. The master control unit 200 is connected between one of the phases and neutral. Each of the output control units 201–203 can take the form shown in FIGS. 5A–5C. The terminals shown in FIG. 7 correspond to the terminals shown in FIGS. 5A–5C. Thus, the line terminal of output control unit 201 is connected to phase 1 of the three phase source. The neutral terminal is connected to neutral and one bank of the fluorescent light fixtures can be connected between neutral and the load terminal of output control unit 201. The line terminal of output control unit 202 is connected to phase 2 of the three phase supply and the neutral terminal is connected to the neutral line. A second bank of light fixtures can then be connected between the neutral line and the load terminal of output control 202. The line terminal of output control 203 is connected to phase 3 of the three phase source and the neutral terminal is connected to the neutral line. A third bank of light fixtures can be connected then between the neutral line and the load terminal of output control unit 203. Additional output control units can be provided. The voltage supply plus terminal from master unit 200 is connected to terminal 1 of output control unit 201. As can be seen from FIG. 5A, terminal 1 of output control unit 201 is also connected to terminal 3. Thus, output control units 201, 202 and 203 are connected in parallel to the voltage supply plus terminal of master unit 200. The frequency signal $F_{IN}$ is connected from master unit 200 to terminal 2 of output control unit 201. Since terminal 2 as shown in FIG. 5A is also connected to terminal 4, all output control units are connected in parallel to receive the setpoint signal in the form of a frequency signal. The advantage of this arrangement is that the setpoint control signal $F_{IN}$ will result in each output control unit controlling their respective switches at the same point in their respective phases without the necessity of providing more elaborate circuitry to make sure that the output control units are matched and will drive their respective fluorescent lights at the same illumination level.

The embodiments of the invention in which an exclusive property or right is claimed are defined as follows:

1. A control arrangement for dimming a fluorescent light, said fluorescent light being supplied with an electrical signal having an electrical signal waveform of varying magnitudes and having both a positive and a negative half cycle, said control arrangement positioning a notch of reduced signal magnitude within said electrical signal waveform wherein said fluorescent light has an illumination level dependent upon the position of said notch, said arrangement comprising:

load control means for controlling the supply of said electrical signal to said fluorescent light, said load control means comprising a first gate turn off device and a first SCR for controlling said electrical signal during said positive half cycle and a second gate turn off device and a second SCR for controlling said electrical signal during said negative half cycle, said gate turn off devices conducting during their respective half cycles prior to said notch and said first and second SCRs for conducting during their respective half cycles subsequent to said notch, neither said gate turn off devices nor said SCRs conducting during the notch in their respective half cycles, and a first parallel switch and a second parallel switch for connection in parallel to said fluorescent light, said first parallel switch being turned on during said positive half cycle and said second parallel switch being turned on during said negative half cycle;

light level determining means for providing a light level signal having a frequency determinative of the amount of light to be emitted by said fluorescent light; and light control means responsive to said electrical signal and a counter responsive to the frequency of said light level signal for controlling said load control means to position said notch within said electrical signal waveform in accordance with said light level signal.

2. The arrangement of claim 1 wherein said load control means comprises at least one gate turn off device for conducting prior to said notch and at least one SCR for conducting subsequent to said notch during said electrical signal waveform, both said gate turn off device and said SCR being nonconducting during said notch.

3. The arrangement of claim 2 wherein said light control means comprises GTO logic means responsive to said counter for turning on said first and second gate turn off devices at the beginning of their respective half cycles and for turning said first and second gate turn off devices off at the beginning of the notch in their respective half cycles, said light control means further comprises SCR logic means responsive to said counter for turning on said first and second SCRs at the end of their notches in their respective half cycles and for maintaining said first and second SCRs on during the remainder of their respective half cycles.

4. The arrangement of claim 3 wherein said light control means comprises positive and negative half cycle signal means responsive to said electrical signal for providing a positive half cycle signal during the positive half cycle and a negative half cycle signal during said negative half cycle, said positive and negative half cycle signal means including reset means for resetting said counter at zero crossover points in said electrical signal.

5. The arrangement of claim 4 wherein said gate turn off logic means comprises first gate turn off control means responsive to said positive half cycle signal for allowing said first gate turn off device to be controlled during the positive half cycle and second gate turn off control means responsive to said negative half cycle signal for allowing said second gate turn off device to be controlled during said negative half cycle, said SCR logic means comprising first SCR control means responsive to said positive half cycle means for allowing said first SCR to be controlled during positive half cycles and second SCR control mean responsive to said negative half cycle signal for allowing said second SCR to be controlled during said negative half cycle.

6. The arrangement of claim 1 wherein said electrical signal waveform has a positive half cycle and a negative half cycle and wherein said load control means comprises a first parallel switch and a second parallel switch for connection in parallel to said fluorescent light, said first parallel switch being turned on during said positive half cycle and said second parallel switch being turned on during said negative half cycle.

7. The arrangement of claim 6 wherein said light control means comprises positive and negative half cycle signal mean responsive to said electrical signal for providing a positive half cycle signal during the positive half cycle and a negative half cycle signal during said negative half cycle, said positive and negative half cycle signal means including reset means for resetting said counter at zero crossover points in said electrical signal waveform.

8. The arrangement of claim 1 wherein said electrical signal waveform has reference points and wherein said light control means comprises reset means responsive to said reference points for resetting said counter at said reference points.

9. The arrangement of claim 1 wherein said light control means comprises full on means responsive to a substantially full on signal for controlling said light control means for continually energizing said fluorescent light.

10. The arrangement of claim 9 wherein said light control means comprises full off means responsive to a substantially off light level signal for controlling said load control means for maintaining said electric light in a substantially off condition.

11. The arrangement of claim 1 wherein said light control means comprises means for requiring a minimum on time of said load control means prior to said notch except when said light is to be full off to prevent flicker free operation.

12. A control arrangement for dimming a fluorescent light, said fluorescent light being supplied with an electrical signal having an electrical signal waveform of varying magnitude and having both a positive and a negative half cycle, said electrical signal waveform having a notch of reduced signal magnitude therein, said notch having a leading edge and a trailing edge with a center between said edges, said control arrangement controlling the position of said notch by positioning said edges and said center of said notch within said electrical signal waveform wherein said fluorescent light has an illumination level dependent upon the position of said notch, said arrangement comprising:

load control means for controlling the supply of said electrical signal to said fluorescent light, said load control means comprising a first gate turn off device and a first SCR for controlling said electrical signal during said positive half cycle and a second gate turn off device and a second SCR for controlling said electrical signal during said negative half cycle, said gate turn off devices conducting during their respective half cycles prior to said notch and said first and second SCRs for conducting during their respective half cycles subsequent to said notch, neither said gate turn off devices nor said SCRs conducting during the notch in their respective half cycles, and a first parallel switch and a second parallel switch for connection in parallel to said fluorescent light, said first parallel switch being turned on during said positive half cycle and said second parallel switch being turned on during said negative half cycle;

light level determining means for providing a light level signal having a frequency determinative of the amount of light to be emitted by said fluorescent light; and light control means responsive to said electrical signal and a counter responsive to the frequency of said light level signal for controlling said load control means to position said notch by positioning said edges and said center within said electrical signal waveform in accordance with said light level signal.

13. The arrangement of claim 12 wherein said load control means comprises at least one gate turn off device for conducting prior to said notch and at least one SCR for conducting subsequent to said notch during said electrical signal waveform, both said gate turn off device and said SCR being nonconducting during said notch.

14. The arrangement of claim 13 wherein said light control means comprises GTO logic means responsive to said counter for turning on said first and second gate turn off devices at the beginning of their respective half cycles and for turning said first and second gate turn off devices off at the beginning of the notch in their respective half cycles, said light control means further comprises SCR logic means responsive to said counter for turning on said first and second SCRs at the end of their notches in their respective half cycles and for maintaining said first and second SCRs on during the remainder of their respective half cycles.

15. The arrangement of claim 14 wherein said light control means comprises positive and negative half cycle signal means responsive to said electrical signal for providing a positive half cycle signal during the positive half cycle and a negative half cycle signal during said negative half cycle, said positive and negative half cycle signal means including reset means for resetting said counter at zero crossover points in said electrical signal.

16. The arrangement of claim 15 wherein said gate turn off logic means comprises first gate turn off control means responsive to said positive half cycle signal for allowing said first gate turn off device to be controlled during the positive half cycle and second gate turn off control means responsive to said negative half cycle signal for allowing said second gate turn off device to be controlled during said negative half cycle, said SCR logic means comprising first SCR control means responsive to said positive half cycle means for allowing said first SCR to be controlled during positive half cycles and second SCR control means responsive to said negative half cycle signal for allowing said second SCR to be controlled during said negative half cycle.

17. The arrangement of claim 16 wherein said electrical signal waveform has a positive half cycle and a negative half cycle and wherein said load control means comprises a first parallel switch and a second parallel switch for connection in parallel to said fluorescent light, said first parallel switch being turned on during said positive half cycle and said second parallel switch being turned on during said negative half cycle.

18. The arrangement of claim 17 wherein said light control means comprises positive and negative half cycle signal means responsive to said electrical signal for providing a positive half cycle signal during the positive half cycle and a negative half cycle signal during said negative half cycle, said positive and negative half cycle signal means including reset means for resetting said counter at zero crossover points in said electrical signal waveform.

19. The arrangement of claim 17 wherein said electrical signal waveform has reference points and wherein said light control means comprises reset means responsive to said reference points for resetting said counter at said reference points.

20. The arrangement of claim 17 wherein said light control means comprises full on means responsive to a substantially full on signal for controlling said load control means for continually energizing said fluorescent light.

21. The arrangement of claim 20 wherein said light control means comprises full off means responsive to a substantially off light level signal for controlling said load control means for maintaining said electric light in a substantially off condition.

22. The arrangement of claim 17 wherein said light control means comprises means for requiring a minimum on time of said load control means prior to said notch except when said light is to be full off to prevent flicker free operation.

23. The switch of claim 17 wherein said gate turn off device means comprises a first gate turn off device having a gate and first and second terminals, a second gate turn off device having a gate and first and second terminals, wherein said SCR means comprises a first SCR having a gate and first and second terminals, a second SCR having a gate and first and second terminals, wherein said connecting means comprises first connecting means connecting said second terminals of said first gate turn off device and said first SCR to said source terminal, second connecting means connecting said second terminals of said second gate turn off device and said second SCR to said load terminal, and third connecting means connecting said first terminals of said first and second gate turn off devices and said first and second SCRs together and to said source and load terminals so that said first gate turn off device is connected in parallel to said first SCR and said second gate turn off device is connected in parallel to said second SCR, and wherein said control means is connected to said gates of said first and second gate turn off devices and of said first and second SCRs for controlling current flow between said source and load terminals through said first gate off device and said first SCR during positive half cycles of said electrical signal and through said second gate turn off device and said second SCR during negative half cycles of said electrical signal.

24. The switch of claim 23 wherein said control means includes means for turning on said first and second gate turn off devices at zero points in the electrical signal and for turning off said first and second gate turn off devices at a selected non-zero phase in their respective half cycles.

25. The switch of claim 24 wherein said control means comprises means for turning on said first and second SCRs at corresponding points in said respective positive and negative half cycles a predetermined amount of time after said corresponding first and second gate turn off devices are turned off.

* * * * *

UNITED STATES PATENT AND TRADEMARK OFFICE

CERTIFICATE OF CORRECTION

PATENT NO. : 4,904,906

DATED : February 27, 1990

INVENTOR(S) : Larry S. Atherton et al.

It is certified that error appears in the above-identified patent and that said Letters Patent is hereby corrected as shown below:

Column 10, lines 7 and 20, delete "mean" and insert --means--.

Column 11, line 64, delete "claim 16" and insert --claim 12--.

Column 12, line 13, delete "claim 17 and insert --claim 12--.

Column 12, line 18, delete "claim 17" and insert --claim 12--.

Column 12, line 28, delete "claim 17" and insert --claim 12--.

Signed and Sealed this

Nineteenth Day of March, 1991

*Attest:*

HARRY F. MANBECK, JR.

*Attesting Officer*

*Commissioner of Patents and Trademarks*